US005339657A

United States Patent [19]

McMurray

[11] Patent Number: 5,339,657

[45] Date of Patent: Aug. 23, 1994

[54] NET HAVING DIFFERENT SIZE OPENINGS AND METHOD OF MAKING

[75] Inventor: Brian L. McMurray, Aberdeen, N.C.

[73] Assignee: McMurray Fabrics, Inc., Aberdeen, N.C.

[21] Appl. No.: 937,945

[22] Filed: Sep. 1, 1992

[51] Int. Cl.[5] ..... D04B 21/00

[52] U.S. Cl. ..... 66/195; 66/169 R; 87/12; 428/225

[58] Field of Search ..... 66/192, 195, 203, 204, 66/84 R, 205, 207, 233, 234, 237, 242, 169 R; 428/224, 225, 226, 227; 87/12, 13

[56] References Cited

U.S. PATENT DOCUMENTS

| | | | |
|---|---|---|---|
| 1,201,803 | 10/1916 | Chace . | |
| 3,171,272 | 3/1965 | Frith | 66/195 |
| 3,200,619 | 7/1965 | Firth | 66/195 |
| 3,446,039 | 5/1969 | Schmid | 66/235 |
| 3,447,344 | 6/1969 | Zwingenberger | 66/235 |
| 3,578,028 | 5/1971 | Roberts | 66/195 |
| 3,628,354 | 12/1971 | Farwell | 66/235 |
| 3,651,667 | 3/1972 | Titone | 66/195 |
| 3,653,233 | 4/1972 | Titone | 66/195 |
| 3,760,188 | 9/1973 | Plath | 66/242 |
| 3,783,640 | 6/1974 | Bourgeois | 66/195 |
| 3,908,406 | 9/1975 | Maler et al. | 66/234 |
| 4,019,227 | 4/1977 | Ebata | 66/195 |
| 4,056,868 | 11/1977 | Ebata | 66/195 |
| 4,065,835 | 1/1978 | Yoneya | 66/195 |
| 4,215,453 | 8/1980 | Matsuda | 66/195 X |
| 4,364,244 | 12/1982 | Vambutas et al. | 66/75.2 |

*Primary Examiner*—Clifford D. Crowder
*Assistant Examiner*—Larry D. Worrell, Jr.
*Attorney, Agent, or Firm*—Olive & Olive

[57] ABSTRACT

A warp knit net fabric is disclosed in which the number of stitches in each leg and in each join of a diamond pattern is varied to vary the size of the openings defined by the legs. An array of yarn ends are knit on a Raschel warp knitting machine and the formation of stitches of the legs is driven from one pattern chain drum and the formation of stitches of the joins is driven from another pattern chain drum. Switching from drum to drum is accomplished by a programmable controller.

6 Claims, 6 Drawing Sheets

NET HAVING DIFFERENT SIZE OPENINGS AND METHOD OF MAKING

FIELD OF THE INVENTION

This invention relates to the field of knitted materials and more particularly to a knitted net construction having different size openings and to a method of making such a net.

BACKGROUND OF THE INVENTION

It is common to produce netting by warp knitting on a Raschel type knitting machine. The Raschel type machine is capable of knitting from an array of yarn ends threaded through a number of guide bars which shog, or move laterally, as the knitting needles of the machine move vertically. The several guide bars are individually controlled in a manner so as to create a particular stitch pattern.

A net is typically formed with uniform sized diamond shaped openings separated by short sections where the outer corners of adjacent openings are joined together by cross-over stitches. The formation pattern is normally generated by means of a pattern chain which drives the guide bar shogging motion and is made up of a connected series of shaped cam links. These cam links may be replaced with links of a different shape so as to drive the guide bars differently and produce different knitting patterns. However, the operation of changing links and rebuilding a pattern chain is a time consuming one and cannot be efficiently done during a production run. Therefore, nets produced heretofore have been of uniform sized openings.

Knitted netting is created by a series of legs and a series of alternating joins. A leg is a knit cord made of a number of warp yarn ends knit together for a specified number of courses. A join is a crossover connection between two adjacent legs. In order for a particular leg to become one side of a diamond, joins must be made first at one end and then at the other end of the particular leg during knitting.

Ordinarily, a join is a much shorter stitch formation than a leg in a diamond pattern net configuration. It is possible, however, to knit a net with hexagonal, rather than diamond shaped openings, in which case a join is formed approximately the same length as a leg. The principles of the invention disclosed would be applicable to either a diamond or hexagonal shaped net opening.

While nets have been made in the basic manner described above for a long time, it has been a recognized but unsatisfied need to produce a netting with varied width. Frequently, prior art nets are modified from the initial rectangular shape in which they are knitted by the process of sewing sections together. This is usually done to create a net in which the openings and the width in the middle of the net are larger than at the ends of the net, and therefore the net is able to securely support the load in cradle-like fashion. As would be expected, a section of net joined by a stitched seam will tend to be weaker than an all-knit section.

Another reason to control the formation of diamonds in a knit net is to create a particular aesthetic appearance. It has been discovered in reference to the present invention, that by making alternating rows of small and large diamonds, or by gradually increasing and then decreasing the size of the diamonds, one can create a net of unique appearance.

The invention further recognizes that the possibility of varied openings, or orifice, netting potentially leads to applications in cargo nets, fish nets, sports nets and automobile use nets, i.e. nets generally intended to support or contain a load.

A modification of the traditional Raschel type knitting machine is disclosed in U.S. Pat. No. 4,364,244 to Vambutas, et al. for "Memory Controlled Electromagnetic Passive Controllers". The '244 patent teaches a programmable controller operative to actuate a number of solenoid coils which are each mechanically connected to a respective guide bar. The controller program determines solenoid motions and the consequent knit stitch pattern. A major drawback to this machine is that it requires an unusually expensive machine adaptation.

Therefore, an objective of the present invention is provide a knit netting in which the orifice or opening size is larger in one area than in another area.

An additional objective of the invention is to provide a net made on a warp knitting machine with openings of varying sizes.

A further objective of the invention is to be able to efficiently vary the size of diamond shaped openings in a net construction.

A still further objective of the invention is to create a net having alternating large and small openings.

These and other objectives will be apparent through the disclosure below.

SUMMARY OF THE INVENTION

The invention is directed to a unique net construction having different size orifices or openings and the method of making such a net on a Raschel knitting machine. The net so made has one set of diamond shaped openings different in size than another set of diamond shaped openings. This difference in opening size is accomplished by changing the number of stitches per leg between joins. The method for making the variable orifice net of the invention is based on use of knitting machine apparatus capable of switching from a first pattern chain drum which is capable of knitting net legs to a second pattern chain drum which is capable of knitting net joins.

DESCRIPTION OF INVENTION

Figure 1:
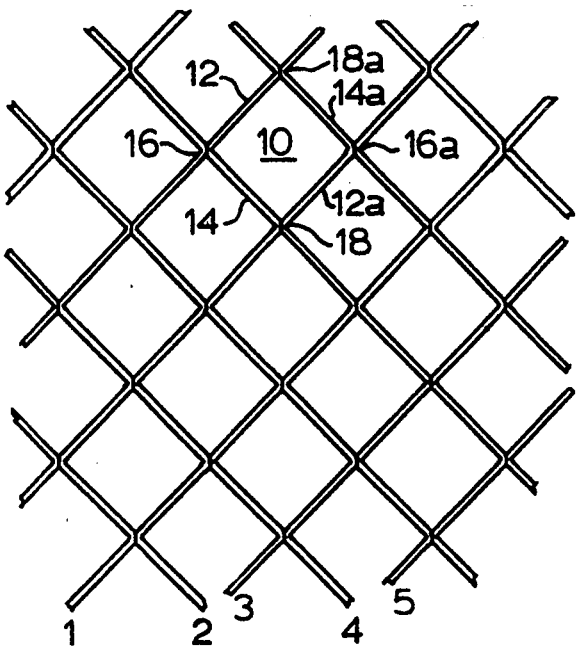
PRIOR ART FIG. 1
FIG. 1 is an illustration of a typical net construction of the prior art in which all diamond shaped openings are substantially equal in size and shape.

A standard diamond netting construction as is typical of the prior art is depicted in FIG. 1. It is to be noted that all diamonds shown, representative of the entire netting fabric, are of substantially the same size. The series of knit cords making up the legs are each marked at the bottom of FIG. 1 in sequence from left to right 1, 2, 3, 4, 5. A typical diamond 10 is formed between legs 12, 12*a* and legs 14, 14*a* which are connected by joins 16, 16*a* and 18, 18*a*. Since each leg at one join is attached on one side of the leg and at the next join is attached on an opposite side of the leg, there are inherently two styles of joins in any type of diamond type net.

Figure 2:
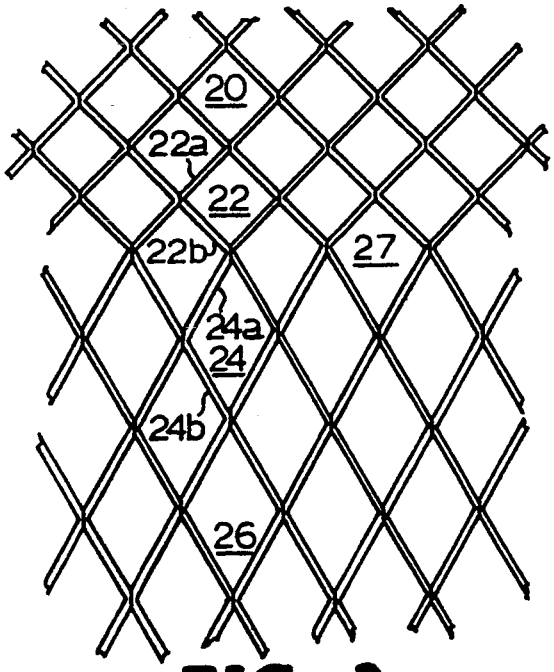
FIG. 2 is an illustration of a first embodiment of the net of the invention in which the diamond shaped openings are not of uniform size and vary from a small diamond in one portion to a large diamond in another, portion of the net.

The netting of the present invention is depicted in a first embodiment in FIG. 2. The net shown in small section illustrates a variation from small diamond orifices or openings 20, 22 to large diamond orifices or openings 24, 26. Whereas the difference in the size of a diamond is accomplished by changing from the relatively short length of legs 22*a*, 22*b* of orifice 22 to the relatively longer length of legs 24*a*, 24*b* of orifice 24, the resultant diamond forming orifice 24 is both larger and somewhat elongated. Consequently, the section of net incorporating the larger diamond openings is proportionally longer.

It is to be noticed that since a diamond is made up of four legs and the knitting produces two of the legs at one end of the diamond first and two of the legs at the other end of the diamond last, advancing in the machine direction, not all diamonds can be symmetrical. In particular, in the row of diamonds where the transition in size occurs, a first pair of small legs and a second pair of long legs creates a non-symmetrical quadralateral opening 27. In essence, the Raschel machine produces legs of netting, which legs are structurally and visually combined by joins to form the orifices or openings of the net.

Figure 3:
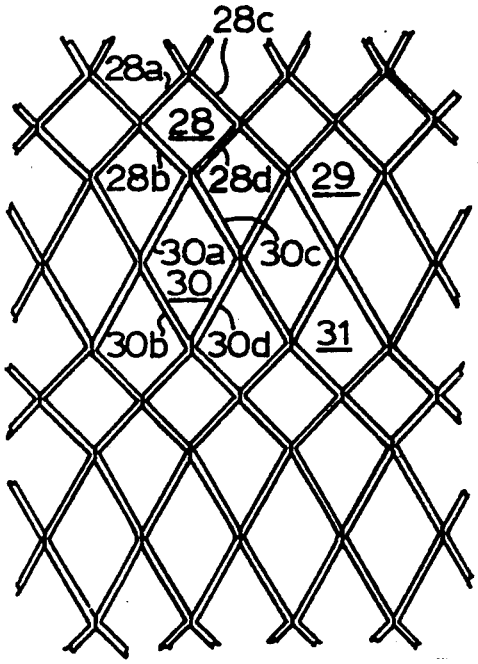
FIG. 3 is a diagram of a portion of a net made according to a second embodiment of the invention and in which the pattern varies alternatingly between small and large diamond shaped openings.

A second embodiment of the present invention, illustrated in FIG. 3, is that which results from the alteration of the size of consecutive diamonds from small to large to small, etc. In this figure, short legs 28*a*, 28*b*, 28*c* and 28*d* form small diamond orifice 28 and long legs 30*a*, 30*b*, 30*c* and 30*d* form large diamond orifice 30. Since the orifices or openings vary alternatingly between small and large, the diamond orifices are extended in length and alternate rows of openings appear as the non-symmetrical quadralateral shaped diamonds 29, 31 as described above.

It is to be understood that in either of the embodiments of the invention shown by FIGS. 2 and 3, the change from short to long legs, and consequently the change from small to large diamonds, may be accomplished rapidly (as illustrated) or gradually through a number of incremental steps.

Figure 4:
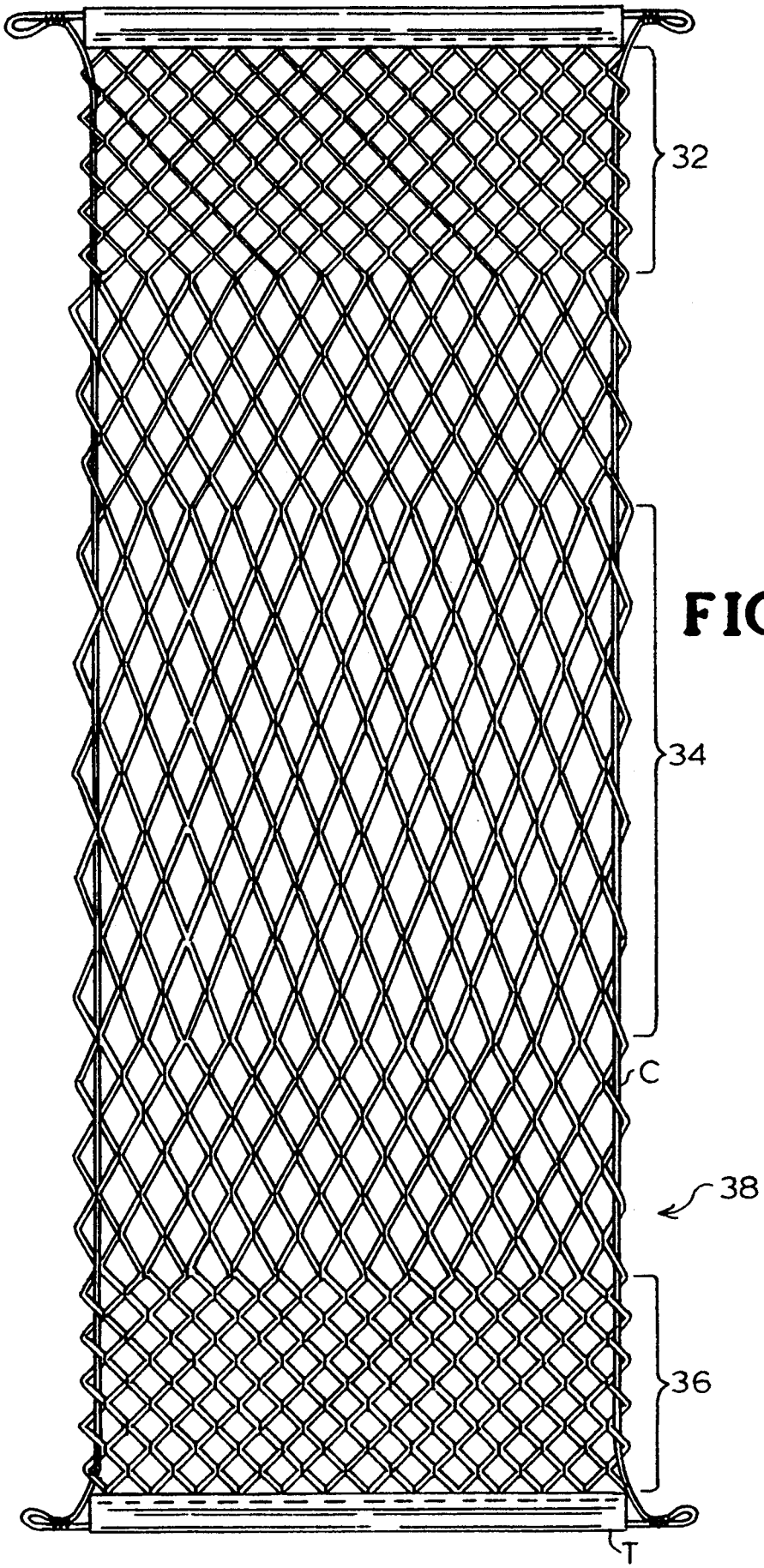
FIG. 4 is a top plan illustration of a completed net structure according to a third embodiment of the invention including side cords and end webbings.
Figure 4A:
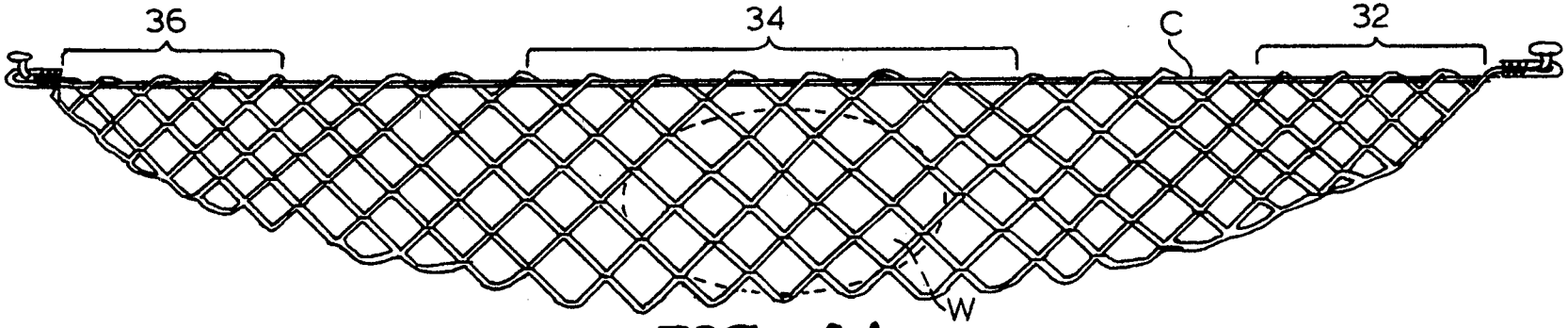
FIG. 4*a* is a side elevation view of the completed net structure of FIG. 4 shown sagging at the center due to a supported weight.

A diagram showing a larger section of netting made according to the embodiment of FIG. 2 and the converted to a finished net product by the addition of side cords C and end webbing T is shown in FIG. 4. In this form, small diamonds at first end 32 of net 38 are increased in succeeding sets of courses to central area 34. Once past center, the size change process is reversed and the diamonds diminish to arrive at the same sized orifices at second end 36 as were at first end 32. By virtue of the large size orifices in center 34, net 38 is longer per diamond in the center 34 as measured in a machine direction than is either end 32 or 36. When a weight W is placed in central section 34 and supported by net 38 as in FIG. 4*a*, the central section 34 will tend to sag downward, wrapping around weight W and affording secure support.

The length of supply yarn, known generally in the industry as the runner length, is regulated to accommodate the number and size of knit stitches made over length of fabric. Some machines utilize a positive runner length control by driving the in-feed yarn and some a negative control by applying tension to the in-feed yarn.

The invention further recognizes that a netting diamond leg of various lengths may be produced from a given size of yarn by at least two possible methods. One method, recognized to be inferior, but nonetheless useful, is to increase the fabric take-up speed and the runner length so as to increase the length and reduce the tightness of each stitch. Alternatively, the take-up speed and the runner length may be decreased so as to shorten the stitch length and increase the tightness of each stitch. The other method, recognized to be preferred, is to maintain the same runner length and to knit a greater or lesser number of stitches per leg and thus vary the length of the knit leg. Maintaining the size and tightness of the individual stitches assures consistent strength and handling properties of the finished net product. The invention disclosed is capable of producing a net with varied size legs and orifices by either method, with the preferred embodiment focusing on the method of varying the number of stitches per leg.

Figure 10:
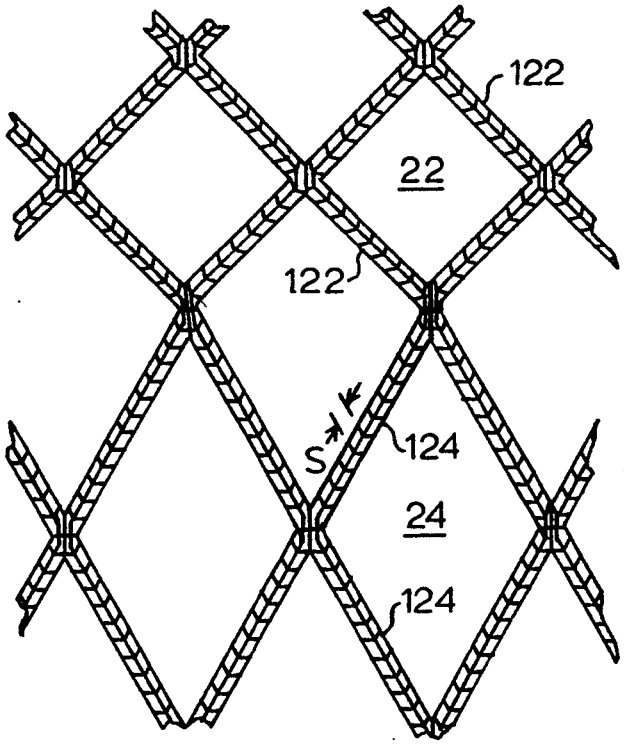
FIG. 10 is a diagram of a portion of a net made according to the invention and enlarged to diagrammatically depict knitting stitches.

An illustration of a portion of net according to the invention having a varying number of stitches forming comparatively short legs 122 and comparatively long legs 124 resulting in proportionally sized openings 22, 24 is seen in FIG. 10. The series of herringbone markings along the length of the knit legs of FIG. 10 diagrammatically represent knit stitches of length S. A relatively small opening 22 is formed by pairs of legs 122 having a selected number of yarn ends forming in each leg a selected and relatively small number of stitches. Additionally large opening 24 is bordered by pairs of legs 124 formed from the same number of yarn ends as in legs 122 but with the number of stitches, not the size (S) of the stitches, being substantially greater. In FIG. 10, each short leg 122 is illustrated simply by way of example as being formed of approximately seven stitches and each long leg 124 as being formed with approximately eleven stitches.

While the general operation of a Raschel warp knitting machine is well known, a limited description will be given so as to relate the conventional machine and its operation to the modified machine and operation of the invention. Those skilled in the art will thus readily appreciate how the invention operates.

Figure 5:
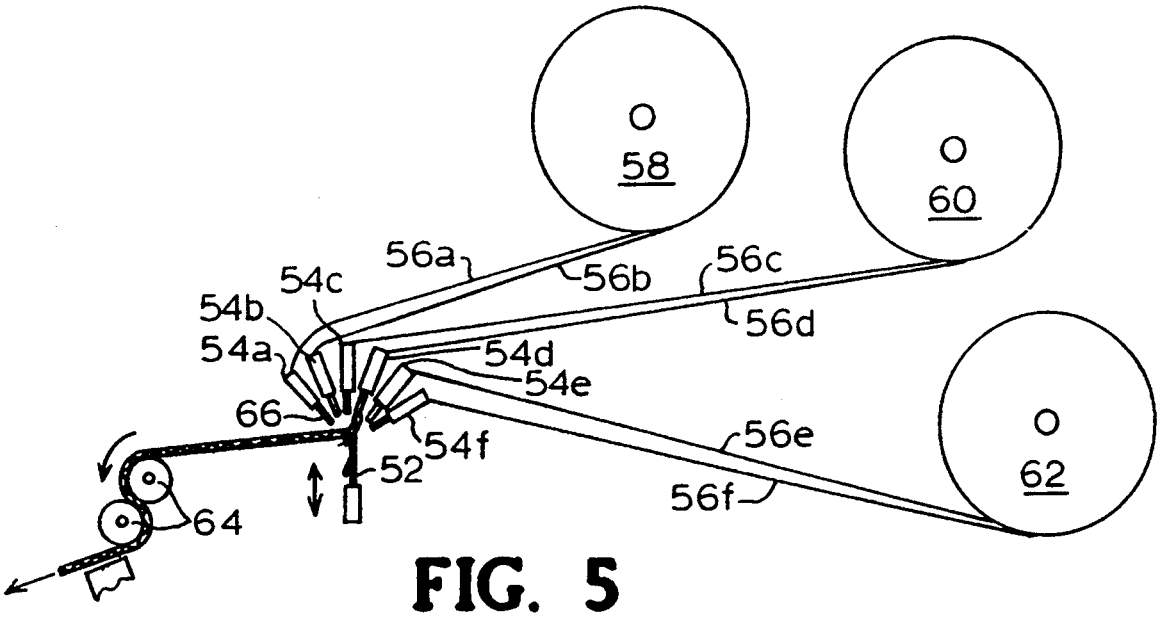
FIG. 5 is a side elevation diagram of selected elements of a Raschel type machine suited to the invention and the knitting process done thereon, showing only six guide bars for clarity.
Figure 6:
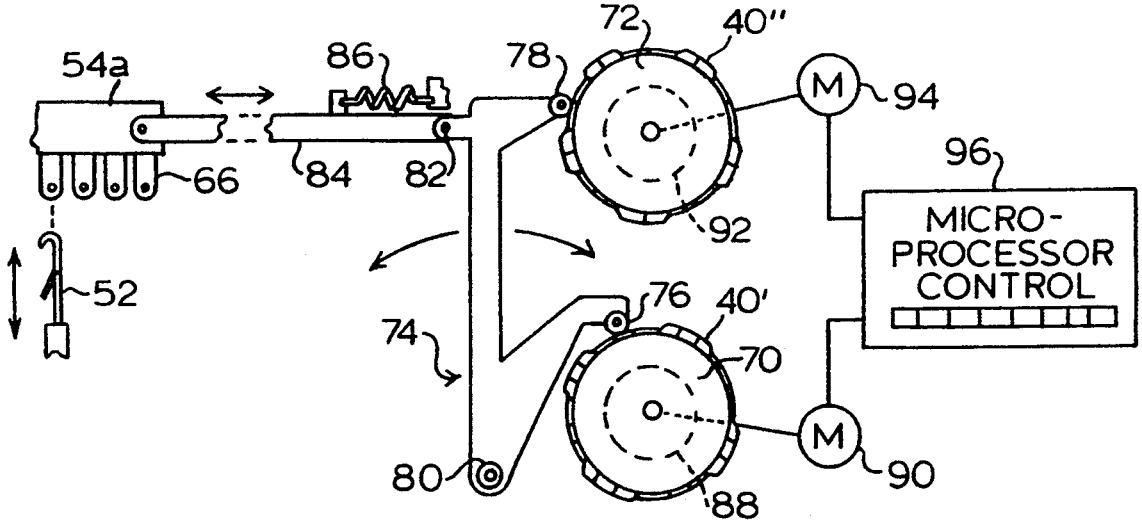
FIG. 6 is a front elevation representation of a modified stitch control mechanism for a Raschel knitting machine showing dual pattern chain drums in accordance with the invention.

The variable orifice net of the invention is produced on a Raschel warp knitting machine selected elements of which are illustrated in FIGS. 5 and 6 as, for example, Model DR-8-10-SP manufactured by Mayer Textile Machine Works and which has eight individually driven guide bars. In the netting construction disclosed, only six of the eight guide bars are employed, therefore only six guide bars are illustrated in the figures. A multiplicity of yarn ends are supplied to the knitting machine in groupings of six ends (56*a*, 56*b*, etc.) per knitted leg from yarn beams 58, 60, 62. A creel yarn supply could be used with similar results. Each of the yarn ends is threaded through a guide 66 on one of the guide bars 54*a* through 54*f* as also indicated in the knitting stitch diagram of FIG. 9. A typical pattern for threading yarn ends through guides on guide bars is as follows:

| Yarn End | Guide Bar | Guide Number |
|---|---|---|
| 1 | 54a | 1 |
| 2 | 54b | 1 |
| 3 | 54c | 1 |
| 4 | 54d | 1 |
| 5 | 54e | 1 |
| 6 | 54f | 1 |
| 7 | 54a | 2 |
| 8 | 54b | 2 etc. |

As such, yarn ends 1–6 are knitted together by the action of latch needle 52 and the shogging of guide bars 54*a* through 54*f* into a first leg, yarn ends 7–12 form a second leg, etc. The specific details of the stitch pattern will be discussed below in relation to FIG. 9.

Guide bars 54*a*–54*f* are moved laterally in a direction perpendicular to the vertical movement of latch needle The lateral or shogging, motion of guide bars 54*a*–54*f*, in coordination with the vertical movement of each latch needle 52 creates a knitted stitch per course. As latch needles 52 and guide bars 54*a*–54*f* interact to knit stitches, fabric take-up rollers 64 draw the knitted netting off at a selected, steady speed.

Figure 7:
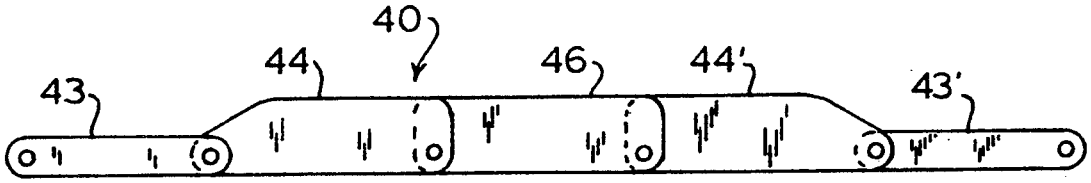
FIG. 7 is an illustration of a section of a typical pattern chain used for stitch control in a Raschel knitting machine.

The shogging motion of guide bars 54*a–f* is driven by a parallel group of pattern chains 40, a typical short section of which is shown in FIG. 7. Each pattern chain 40 is made up of a series of cam links which are configured in several types, low links 43, 43', riser link 44 and high link 46. It will be noticed that riser 44 is the identical link to a link 44' oriented in the opposite direction to riser 44 so as to create a lowering link 44'. Each riser link 44 corresponds moving a guide bar laterally in shogging motion to form an overlap and a lowering link 44' to return to its original position and form an underlap. By connecting a series of lines together according to a design pattern, a physical analogy of the guide bars shogging motion can be created. It takes a set of three links to make one stitch. The pattern chain, when constructed, is wrapped around a pattern chain drum which is rotated while the links of the pattern chain are in contact with a cam follower so as to produce the required guide bar motions. One pattern chain is used for each guide bar.

In the prior art net construction, a pattern chain is used which is capable of producing a series of leg forming stitches followed by a join forming stitch followed by another series of leg forming stitches followed by another join forming stitch. It is apparent since each stitch evolves from three chain links, that a long pattern chain is required. It is also apparent that building such a chain is a substantial labor-intensive undertaking. In addition, each time a detail of net construction is to be changed, the chain must be modified or rebuilt.

The physical relationship in the present invention of pattern chain drums 70, 72 and cam follower arm 74 is illustrated in FIG. 6. Whereas the standard Raschel machine has one pattern chain drum to act upon the cam follower arm, the machine of the invention has been modified to employ a plurality of pattern drums. In the illustration of the preferred embodiment two pattern drums, leg pattern drum 70 and join pattern drum 72 are shown. However, it is understood that a greater number of pattern drums could be incorporated in the principles of the invention disclosed. For example, since one style of join results from a different chain configuration than does another style of join, the two-drum embodiment requires both join styles to be made from a single drum. If an additional pattern chain drum were used it would thus be possible to have separate drums for two styles of joins.

With continuing reference primarily to FIG. 6, at the beginning of the knitting process, join drum 72 is still and leg drum 70 is rotating. As leg drum 70 rotates, the various links of chain 40' drive connecting rods 84, and consequently guide bar 54*a* in knitting the legs of the net diamond pattern. Cam follower arm 74 is biased by spring 86 toward leg pattern chain 40' which is directly contacted by cam follower 76. Although described in the singular, the elements of the control system described represent a series of six units in parallel alignment, each driven by a separate pattern chain on leg pattern drum 70. As long as leg pattern drum 70 continues to operate, a leg knit pattern, i.e. six yarn ends knitted into a leg, will be produced. Leg pattern drum 70 is driven by motor 90 which drive is transmitted through a clutch/brake unit 88.

As motor 90 rotates leg drum 70, a signal representative of the number of stitches knit is generated by an optical signal generator (not shown) suitably located on the knitting machine and is input to microprocessor 96. Microprocessor 96 is programmed to count stitches until a preset number is reached, and then to produce a signal so as to cause clutch/brake 88 to deactivate the clutch and activate the brake mode, thus stopping rotation of leg drum 70. Simultaneously, microprocessor 96 activates the clutch segment of clutch/brake 92 which connects motor 94 to join drum 72, beginning the process of knitting a join between two adjacent knit cords. Since joins in any type of diamond net, as previously referred to, are of two styles, one half of the pattern chain 40'' used on join drum 72 operates to form one style join and the other half to form the other style join, the microprocessor being capable of stopping and starting action in fractional incremental rotations of the drums. An opposite switch from join drum 72 to leg drum 70 occurs after formation of the join is accomplished.

Microprocessor 96 can switch control between two or a larger number of drums and can be programmed for a large range of numbers of courses of both leg stitches and join stitches. Microprocessor 96 is utilized, if operation is according to the secondary embodiment, to vary yarn runner length per Leg while maintaining equal numbers of formed stitches. It is not deemed necessary to discuss the operation of a programmable microprocessor, as such are standard machine control components available from a large number of sources.

The action imparted to guide bar 54a from either leg drum 70 or join drum 72 is shogging left and right. The yarn ends are then brought to intercept latch needle 52 as these yarn ends pass through the hole in guide 66. The regular vertical oscillation of latch needle 52 with latch 52' combines to interknit the yarn according to a prescribed pattern of leg or join all of which will be well understood by those skilled in the art.

Figure 8:
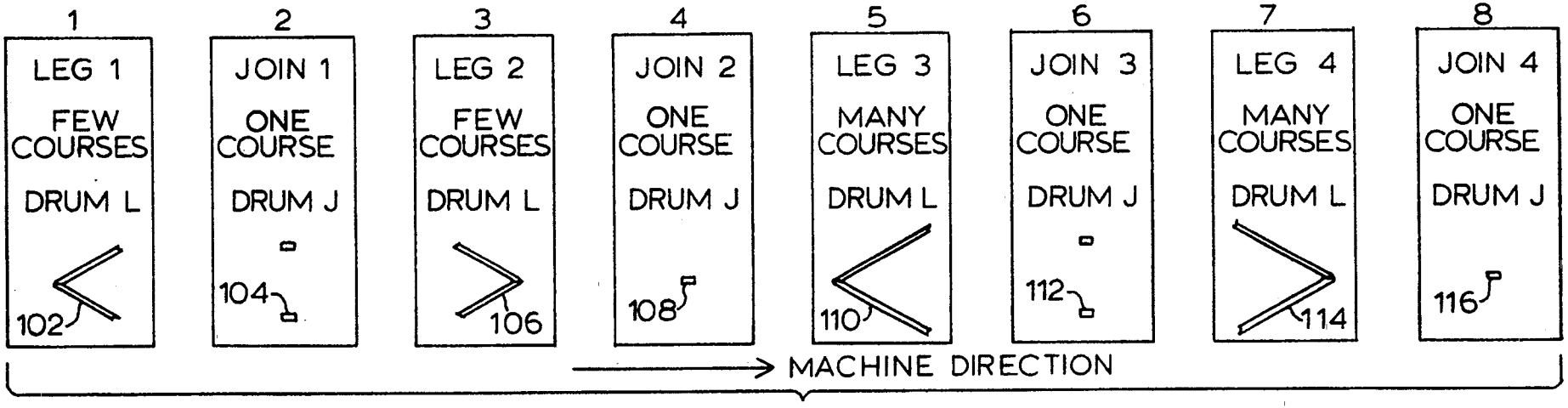
FIG. 8 is a schematic illustration of the method of the invention showing each step used and the result of each step on the knitted netting produced, by way of example, according to FIG. 3.

The process of the invention is shown diagrammatically in sequential steps in the machine direction in FIG. 8.

Each of the steps 1–8 represented in FIG. 8 shows a change from forming legs to forming joins. In step one, diverging short leg 102 is formed across the entire width of the net being produced as a short leg, having few courses and being controlled by the rotation of leg drum (Drum L) 70. The next step two produces join 104 having one course and controlled by join drum (Drum J) 72. The next step three is the production of converging short leg 106, having a few courses of stitches and controlled by Drum L. The next step four produces join 108 having one course and controlled again by Drum J. It is now noticed that there is an alternation between Drum L for the formation of Leg stitches and Drum J for the formation of join stitches and also that Drum J operates to produce one stitch per join and Drum L for a snort leg operates to produce a few courses of stitches. The next step five is to produce divergent long leg 110 which has many courses and is controlled by Drum L, the difference being that Drum L will continue to rotate for a larger number of stitches than it did in the production of the short legs represented by steps one and three. Next, step six produces join 3 having one stitch and operating from the motion of Drum J. The next step seven produces long Leg 414 having many courses and being driven by Drum L. The next and final step eight produces join 4 having one stitch and being driven by Drum J. Whereas joins and 3 are formed on the outer corners of the diamonds as the legs diverge, such joins are, for example, of one style; similarly, joins 2 and 4 being at the convergent corners of the diamonds being produced are, for example, of another style as previously described.

The series of steps 1–4 of FIG. 8 described above, form one complete diamond shaped pattern having a relatively small opening. The steps 5–8 of FIG. 8 represent the production of a relatively large opening diamond pattern. In actual production on the Raschel knitting machine, all legs are formed substantially parallel to each other in the warp direction and are only recognizable as generating a diamond pattern when the knitting is completed and the net fabric is spread widthwise.

Figure 9:
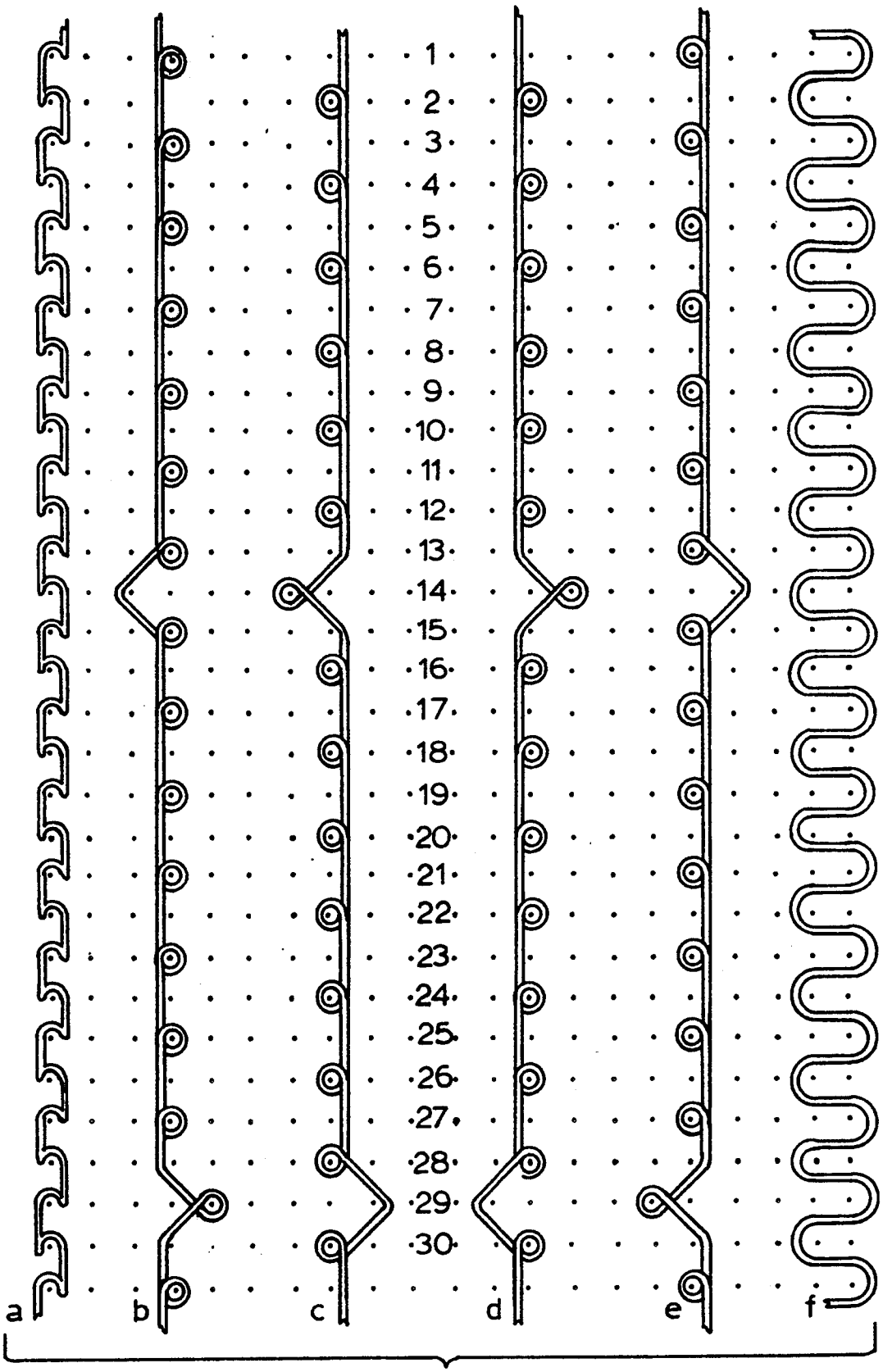
FIG. 9 is a knitting pattern diagram showing the stitch formation for a single opening of a net produced as in FIG. 2 on a six guide bar machine according to the invention.

The formation of a single diamond of warp knit net as described in relation to FIG. 8 in steps 1–4 (for example) is equivalent to the stitch pattern from courses 1–30 of FIG. 9. In this knitting pattern diagram, each end of yarn a–f is shown separately, but it is understood that they interact with one another and are knit together, the stitch-representative dots being, in effect, coincident along a single line. The series of vertical numerals down the center of FIG. 9 represent sequential courses of knitting. The leg portion shown from courses 1 through 13 is produced control from the leg pattern chain 40' of leg pattern drum 70 of FIG. 6. The join shown as course 13 is produced by join pattern chain 40'' on join pattern drum 72. Yarn end a continuously knits an alternating stitch on the left and right side of the latch needle as indicated by the diagram; this continues through join sections and leg sections alike. Yarn end b knits on the legs to the right and shogs left for a join of one style at course 13 and further is shown to shog right for a join of another style at course 29. Yarn c, yarn d, yarn e follow similar patterns to that of yarn end b. Yarn end f is driven in a sinusoidal path between a right stitch and a left stitch and continues to knit according to that pattern throughout joins and legs. The finished leg is a combination of all six of the yarn ends superimposed on one another as activated by the motions of the six guide bars and six pattern chains.

The description above relates to a preferred and other embodiments of the invention. Variations as to number of yarn ends, number of stitches per leg or per join, comparative length of short and long legs, etc. are considered to be within the principle and scope of the invention. Therefore, the examples above are not considered limitations on the scope of the invention.

I claim:

1. A warp knit net, comprising:

(a) a plurality of warp knit cords extending in side-by-side relation between opposite ends of the net, each cord formed of a selected number of ends of yarn which number remains uniform throughout the length of the cord;

(b) warp knit joins formed at intervals along the length of each cord to successively join each cord to a first cord on one side of said each cord followed by being joined to a second cord on the opposite side of said each cord whereby to form between each pair of joins one leg of a net opening of a desired size with the length of each said leg being directly proportional to the number of warp knit stitches therein;

(c) the intervals at which said joins are formed in a first portion of the net being of one selected number of stitches and in a second portion of the net being of a different selected number of stitches whereby to vary the length of said legs and thereby vary the size of said openings in said second portion in contrast to the size of openings in said first portion; and (d) the same number of openings being formed in each row widthwise in all portions of the net.

2. A warp knit net as claimed in claim 1 including a cord running lengthwise on each side of the net and a webbing secured to each end of the net.

3. A warp knit net as claimed in claim 1 wherein said joins comprise relatively few warp knit stitches compared to the number of stitches in each said leg and each said opening assumes a diamond shape when said net is in a widthwise stretched condition.

4. A warp knit net as claimed in claim 1 wherein said joins comprise a similar number of stitches as do said legs and each said opening assumes a hexagonal shape when said net is in a widthwise stretched condition.

5. A warp knit net as claimed in claim 1 wherein said first portion of the net is located at a first end thereof and said second portion is located adjacent said first portion at a location intermediate the length of the net and further including a third portion formed similar to said first portion and whereby the size of openings formed in each said first portion and said third portion are smaller than the openings formed in said second portion.

6. A warp knitted net as claimed in claim 1 including a cord running lengthwise on each side of the net and a webbing secured to each end of the net and wherein said join comprise relatively few warp knit stitches compared to the number of stitches in each said, leg and each said opening assumes a diamond shape when said net is in a widthwise stretched condition.

* * * * *

UNITED STATES PATENT AND TRADEMARK OFFICE

CERTIFICATE OF CORRECTION

PATENT NO. : 5,339,657
DATED : August 23, 1994
INVENTOR(S) : Brian L. McMurray

It is certified that error appears in the above-indentified patent and that said Letters Patent is hereby corrected as shown below:

Column 2, line 20, insert --to-- before "provide".

Column 4, line 27, correct "over" to read --per--.
Column 5, line 40, after "needle" insert --52.--
Column 5, line 55, after "corresponds" insert --to--.
Column 7, line 1, correct "Leg" to read --leg--.
Column 7, line 32, correct "snort" to read --short--.
Column 7, line 40, correct "Leg" to read --leg--.
Column 7, line 43, after "joins" insert --1--.
Column 8, line 1, after "produced" insert --by--.
Column 10, line 1, correct "join" to read --joins--.
Column 10, line 2, remove the comma (,) after "said".

Signed and Sealed this

Eighth Day of November, 1994

*Attest:*

*Attesting Officer*

Bruce Lehman

BRUCE LEHMAN

*Commissioner of Patents and Trademarks*